US005722538A

United States Patent [19]

Neely et al.

[11] Patent Number: 5,722,538

[45] Date of Patent: Mar. 3, 1998

[54] LABEL ASSEMBLY FOR PACKAGE SLEEVE ACCOMMODATING A STORAGE MEDIA DISC AND METHOD FOR SEALING A PACKAGE SLEEVE

[75] Inventors: Phillip K. Neely; Joseph D. Cresgy, both of Terre Haute, Ind.

[73] Assignees: Sony Corporation, Tokyo, Japan; Digital Audio Disc Corporation, Terre Haute, Ind.

[21] Appl. No.: 729,773

[22] Filed: Oct. 8, 1996

Related U.S. Application Data

[63] Continuation of Ser. No. 407,717, Mar. 21, 1995, abandoned, which is a continuation-in-part of Ser. No. 261,681, Jun. 17, 1994, abandoned.

[51] Int. Cl.[6] ..... B65D 85/30; B65D 85/00; G09F 3/00; B42D 15/00

[52] U.S. Cl. ..... 206/308.1; 206/308.3; 206/459.5; 40/312; 40/630; 40/638; 156/277; 156/441.5; 156/442.1; 229/307; 229/313; 283/79; 283/81; 283/100; 283/101; 283/103; 283/105

[58] Field of Search ..... 206/308.1, 308.3, 206/459.5; 40/312, 630, 638; 229/74, 102, 300, 307, 313; 156/227, 291, 277, 442.1, 441.5; 283/81, 79, 100, 101, 103, 105

[56] References Cited

U.S. PATENT DOCUMENTS

| | | | |
|---|---|---|---|
| 1,464,378 | 8/1923 | Wilburger . | |
| 1,827,636 | 10/1931 | Ames . | |
| 3,337,119 | 8/1967 | Bowers et al. | 206/312 |
| 3,426,960 | 2/1969 | Shore | 206/312 |
| 3,717,297 | 2/1973 | Perry | 229/72 |
| 3,767,038 | 10/1973 | Channing et al. | 229/74 |
| 4,771,891 | 9/1988 | Sorensen et al. | 206/459.5 |
| 4,905,831 | 3/1990 | Bagdis et al. | 206/308.3 |
| 5,071,167 | 12/1991 | O'Brien | 283/81 |
| 5,118,375 | 6/1992 | Malachowski et al. | 156/442.1 |
| 5,188,229 | 2/1993 | Bernstein | 206/308.1 |
| 5,217,307 | 6/1993 | McClintock | 206/831 |
| 5,248,032 | 9/1993 | Sheu et al. | 206/308.1 |
| 5,318,222 | 6/1994 | Bartlett | 229/313 |
| 5,333,728 | 8/1994 | O'Brien et al. | 206/312 |

*Primary Examiner*—M. D. Patterson

*Attorney, Agent, or Firm*—William S. Frommer; Alvin Sinderbrand

[57] ABSTRACT

A label assembly for a package sleeve accommodating a storage media disc in a sleeve cavity thereof. The label assembly includes a removable tear strip covering the sleeve cavity such that when the tear strip is detached along perforation lines, the disc can be removed from the sleeve cavity. The tear strip also has a deadened adhesive portion so that no adhesive can contact the disc. In this label assembly, a first face and a second face are positioned on opposite sides of the tear strip. The first face includes mailing identification information regarding the package sleeve and the second face includes disc identification information regarding the storage media disc accommodated within the package sleeve.

36 Claims, 6 Drawing Sheets

FIG. 1
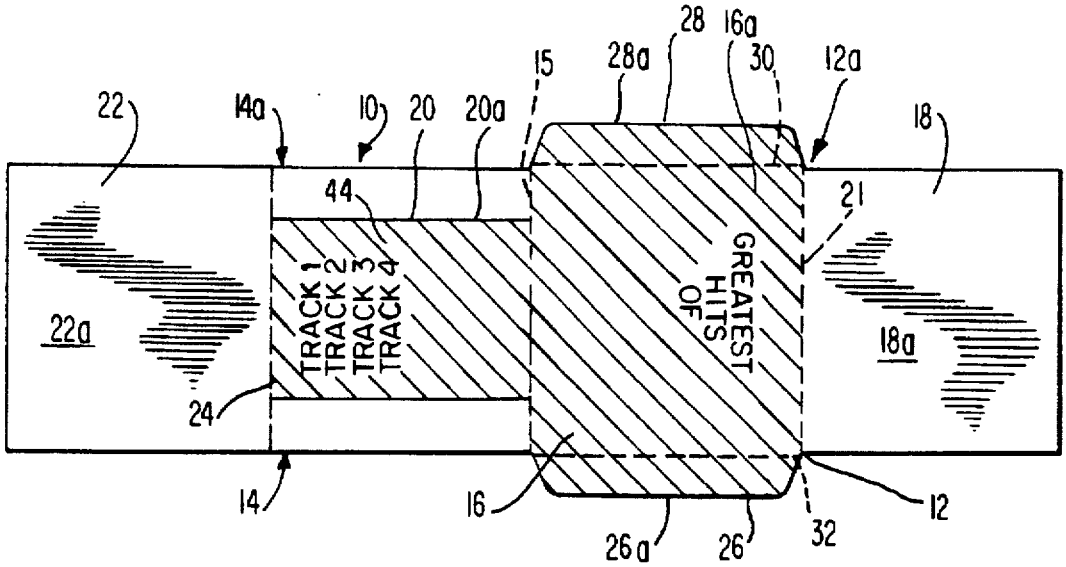
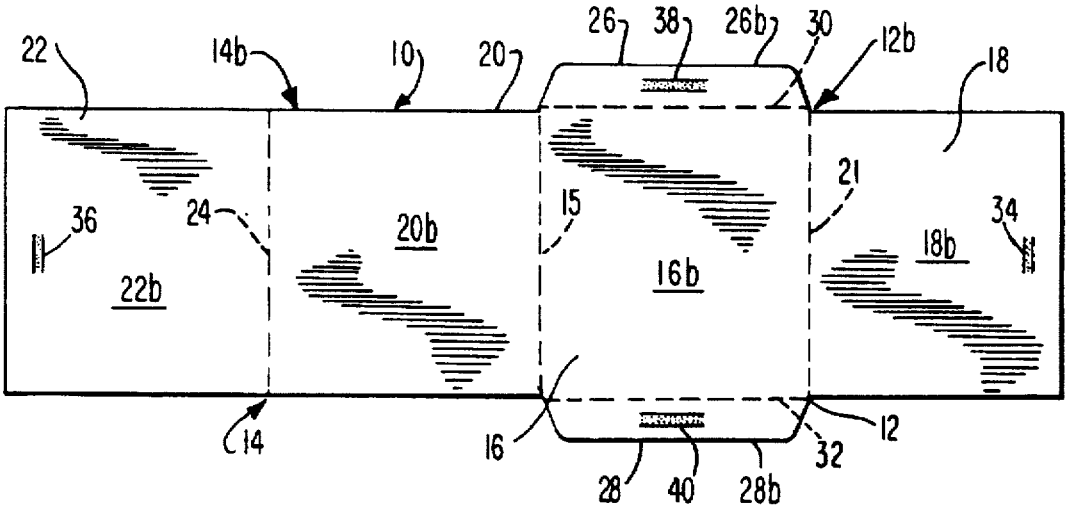
FIG. 2

LABEL ASSEMBLY FOR PACKAGE SLEEVE ACCOMMODATING A STORAGE MEDIA DISC AND METHOD FOR SEALING A PACKAGE SLEEVE

CROSS-REFERENCE TO RELATED APPLICATIONS

This application is a continuation of application Ser. No. 08/407,717, filed Mar. 21, 1995, now abandoned, which is a continuation-in-part application of U.S. patent application Ser. No. 08/261,681, filed Jun. 17, 1994, now abandoned, entitled PACKAGE SLEEVE FOR A STORAGE MEDIA DISC.

FIELD OF THE INVENTION

This invention relates to a label assembly for a package sleeve accommodating a storage media disc and method for sealing a package sleeve. More particularly, in U.S. patent application Ser. No. 08/261,681, assigned to the common assignee of this application, a package sleeve for accommodating a storage media disc is described which is formed of a relatively inexpensive carton blank. This package sleeve includes a front panel and a back panel connected thereto, and two side flap portions connected to the front panel. The front panel comprises a first folded-over double panel including a front portion and a first outer flap portion and the back panel comprises a second folded-over double panel including a back portion and a second outer flap portion. In order to provide a sleeve cavity for containment of the storage disk media between the first and second folded-over double panels, the side flap portions are adhesively attached to the back panel.

In the prior application, it was contemplated that the package sleeve be covered with shrink wrap to seal the open end of the sleeve cavity. Although shrink wrapping has been found to be an effective means for sealing the sleeve cavity, it has been found that consumers are extremely interested in a sealing mechanism which is easily removable to thereby open the sleeve cavity and remove the disc therefrom.

In the package sleeve of U.S. patent application Ser. No. 08/261,681, the interior surfaces and edges of the package sleeve do not scratch or otherwise damage the disc when it is contained in the sleeve cavity as portions of the first and second folded-over double panels facing the sleeve cavity are treated with a coating to provide scratch resistance. Therefore, in order to keep the disc as clean and scratch resistant as possible, it is also desirable to provide an assembly for sealing the sleeve cavity which will not scratch or place adhesive on the disc.

Further, the package sleeve of U.S. patent application Ser. No. 08/261,681 is readily adaptable to automated assembly processes. In accordance therewith and in order to reduce the labor time necessary to assemble a completed package sleeve, it has been consequently found desirable to provide a label assembly for a package sleeve which is also readily adaptable to automated assembly processes.

It is also contemplated that the package sleeve described in U.S. patent application Ser. No. 08/261,681 will be utilized in direct mailing applications to thereby distribute a single CD-ROM selection to several discrete locations. Therefore, it has further been found desirable to provide a label assembly for sealing the sleeve cavity of the package sleeve which also includes pertinent mailing information for direct mailing applications.

OBJECTS AND SUMMARY OF THE INVENTION

Accordingly, it is an object of the present invention to provide a label assembly for a package sleeve accommodating a storage media disc and method for sealing a package sleeve.

More specifically, it is an object of the present invention to provide a label assembly for a package sleeve accommodating a storage media disc which reliably seals the open end of the sleeve cavity of the package sleeve and is readily removable to thereby open the sleeve cavity.

It is another object of the present invention to provide a label assembly for a package sleeve accommodating a storage media disc which seals the open end of the sleeve cavity of the package sleeve which will not scratch or place adhesive on the disc.

It is a further object of this invention to provide a label assembly for a package sleeve accommodating a storage media disc which is readily adaptable to automated assembly processes.

It is yet a further object of this invention to provide a label assembly for a package sleeve accommodating a storage media disc which can be utilized in direct mailing applications.

According to an aspect of the present invention, a label assembly for a package sleeve including a sleeve cavity for accommodating a storage media disc is provided. This label assembly includes a tear strip covering the sleeve cavity such that when the tear strip is detached along perforation lines provided in the label assembly, the disc can be removed from the sleeve cavity. The tear strip also includes a deadened adhesive portion facing the sleeve cavity so that no adhesive can contact the disc.

The label assembly of the present invention also includes a first face and a second face positioned on opposite sides of the tear strip with both the first and second faces having an adhesive backing. In order to utilize the package sleeve in direct mailing applications and thereby distribute a single CD-ROM selection to several discrete locations, the first face of the label assembly includes mailing identification information such as the mailing address, return address, postal idicia and a postal bar code, etc. The first face of the label assembly including this mailing identification information is adhesively applied to the front portion of the package sleeve.

The second face of the label assembly includes product identification information regarding the storage media disc accommodated within the package sleeve. For instance, this product identification information can include text information regarding the disc accommodated in the package sleeve as well as a product identification bar code regarding the particular disc. In addition to the product identification information, an address verification bar code can be provided on the second face referencing the specific mailing identification on the first face of the label will be included for use with an address verification system. The second face of the label assembly is adhesively applied to the back portion of the package sleeve.

The above, and other objects, features and advantages of the present invention will become apparent in the following detailed description of a preferred embodiment which is to be read in conjunction with the accompanying drawings, and in which like reference numerals are used to identify the same or similar parts in the several views.

BRIEF DESCRIPTION OF THE DRAWINGS

FIG. 1 is a plan view of one side of the blank for forming a package sleeve for containing storage media disc;

FIG. 2 is a plan view of the other side of the blank of FIG. 1;

DETAILED DESCRIPTION OF A PREFERRED EMBODIMENT

Figure 3:
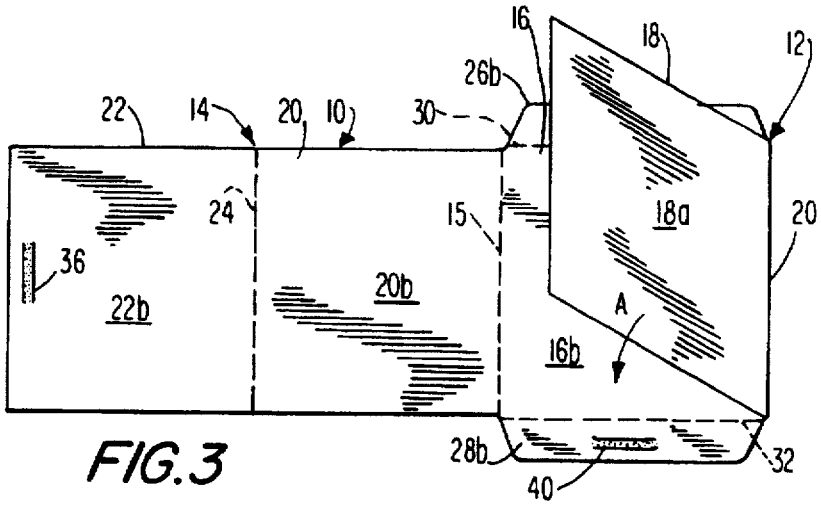
FIGS. 3 through 6 are sequential plan views illustrating the folding of the carton blank of FIGS. 1 and 2 to achieve a package sleeve.

The present invention relates to a label assembly for the package sleeve accommodating a storage media disc, such as the package sleeve described in U.S. patent application Ser. No. 08/261,681, the disclosure of which is specifically incorporated by reference.

Referring now to FIGS. 1 and 2, a carton blank 10 for forming a package sleeve for accommodating storage media discs in accordance with the teachings of U.S. patent application Ser. No. 08/261,681 is illustrated. More specifically, FIG. 1 illustrates one side of the carton blank and FIG. 2 illustrates the opposite side thereof.

As is shown in FIGS. 1 and 2, the blank includes a front panel 12 and a back panel 14 connected to the front panel 12 along fold line 15. The front panel 12 is comprised of a front portion 16 and a first outer flap portion 18 connected to the front portion 16 along bend line 21. The back panel 14 of the blank is comprised of a back portion 20 and a second outer flap portion 22 connected to the back portion 20 along bend line 24. Two side flap portions 26 and 28 are respectively connected to the front portion 16 along bend lines 30 and 32. For purposes of illustration, the features of the front panel 12, back panel 14, front portion 16, outer flap portions 18 and 22, back portion 20 and side flap portions 26 and 28 shown on the side of FIG. 1 have also been designated as 12*a*, 14*a*, 16*a*, 18*a*, 20*a*, 22*a*, 26*a* and 28*a* whereas those features on the other side of FIG. 2 have been designated as 12*b*, 14*b*, 16*b*, 18*b*, 20*b*, 22*b*, 26*b* and 28*b*.

In the preferred embodiment, the carton blank 10 has the following properties:

| | | |
|---|---|---|
| Basis weight, lbs/3,000 Sq. Ft. | | 172 |
| gam | | 279.9 |
| Caliper, .001 inch | | 14.0 |
| mm | | 0.356 |
| Stiffness, Taber | MD | 132 |
| | CD | 65 |
| mNm | MD | 12.95 |
| | CD | 6.38 |
| Brightness, % | CS | 83.0 |
| | UCS | 82.5 |

-continued

| | | |
|---|---|---|
| Moisture, % | | 5.8 |
| Gloss, % | CS | 57 |
| Smoothness | CS | 29 |
| (Sheffield Units) | UCS | 185 |

Such a carton material with the above properties is currently available from International Paper Corporation, Bleached Board Division having the Grade Code 1220, under the tradename Everest which can be described as 14 pnt, SBS, C1S, 0.014", solid bleached sulfite, coated one side.

Figure 4:
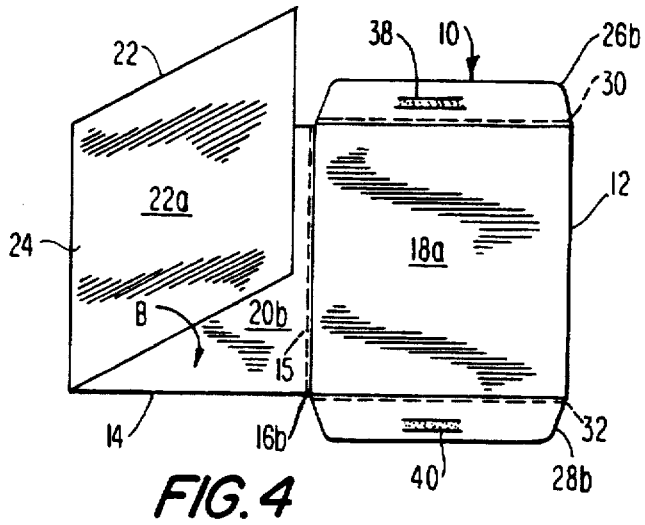
Figure 5:
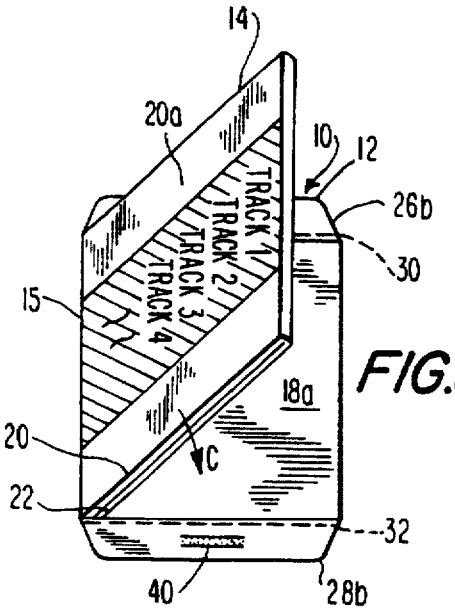

The process for making the package sleeve of U.S. patent application Ser. No. 08/261,681 is illustrated in FIGS. 3 through 6. Initially, the first outer flap portion 18 is folded along fold line 20 in the direction of arrow A as shown in FIG. 3 such that the glue area 34 provided on the side 18*b* of outer flap portion 18 is adhesively attached to the side 16*b* of front portion 16. Next, as is illustrated in FIG. 4, the second outer flap portion 22 is folded along fold line 24 in the direction of arrow B such that the glue area 36 provided on the side 22*b* of outer flap portion 22 is adhesively attached to the side 20*b* of back portion 20. The back portion 20 with the outer flap portion 22 adhered thereto are then folded along fold line 15 in the direction of arrow C (see FIG. 5) such that the outer flap portion 22 is aligned with the outer flap portion 18. Subsequent thereto, the two side flap portions 26 and 28 are respectively folded along fold lines 30 and 32 in the direction of arrows D and E in FIG. 6 such that the glue areas 38 and 40 provided on the respective sides 26*b* and 28*b* of the flap portions are adhesively attached to the rear portion 20. As a result thereof, a sleeve cavity 42 is formed between outer flap portions 18 and 22 for containment of a storage media disc therein. The entire folded blank is then pressed flat. The package sleeve can then be covered with shrink wrap to seal the open end of the sleeve cavity 42.

Figure 6:
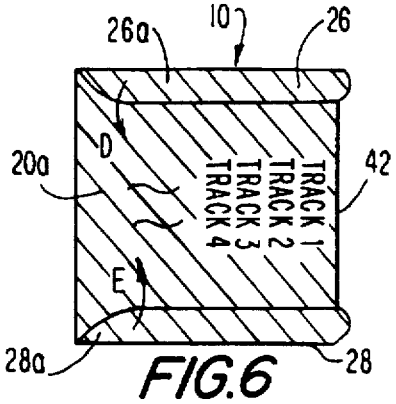
Figure 7:
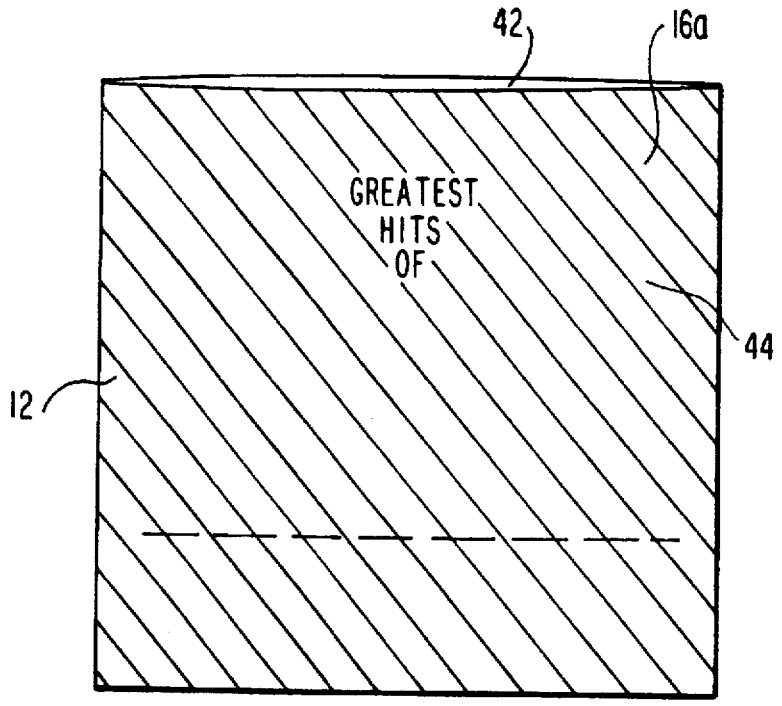
FIG. 7 is a front elevational view of a completed package sleeve made in accordance with the sequential views of FIGS. 3 through 6.
Figure 8:
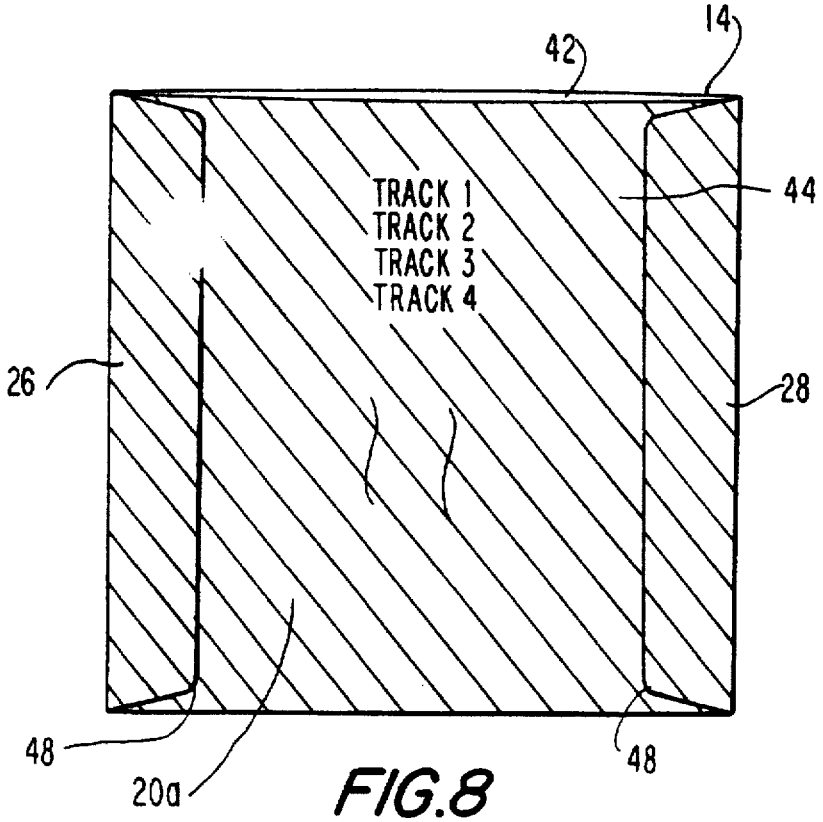
FIG. 8 is a rear elevational view of the package sleeve of FIG. 7.

As is best shown in FIGS. 7 and 8, a package sleeve for accommodating storage media disk is therefore provided having a front panel 12 and a back panel 14 connected thereto along fold line 15 with the two side flap panels 26 and 28 connected to the front panel 12. The front panel 12 is in the form of a first folded-over double panel including the outer flap portion 18 and the front portion 16 and the back panel 14 is in the form of a second folded-over double panel including the outer flap portion 22 and the back portion 20. As is shown in FIGS. 6 and 8, the two side flap portions 26 and 28 are adhesively attached to the back panel 14 to form the sleeve cavity 42 between the outer flap portion sides 18*b* and 22*b* for containment of the storage disc media therein.

As is shown in the figures, the side flap portions 26 and 28 have generally rounded corners, such as 46 and 48 (see FIG. 8). This corner design retards wear of the side flap portions which would be enhanced if sharp corners were present. These rounded corners also provide a generally cleaner appearance to the finished package sleeve.

The carton blank 10 of FIGS. 1 and 2 has also been specifically designed to accommodate a storage media disc (i.e., compact or ROM compact disc) having a diameter no greater than 12 cm. As designed, the overall blank 10 has a dimension of approximately 19¾" in length and 6⅝" in width. The front portion 16 has a dimension of approximately 5" in length and 5⅛" in width whereas the back portion 20 has a dimension of approximately 5" in length and 4 15/16" in width. The outer flap portions 18 and 22 both have dimensions of approximately 4⅞" in length and 4 15/16" in width. The fold lines are preferably 1/16" wide. Moreover, in order to provide product consistency, the paper stock grain direction of the blank is along the length thereof.

These internal dimensions of the sleeve assist in keeping the disc trapped after insertion. This package sleeve can be turned open side down and shaken without the disc becoming dislodged. The only way to remove the disc from the sleeve is to apply light pressure to the sides of the sleeve in order to make the sleeve cavity "pucker." Without this external pressure on the sleeve the disc remains gently held in place by the extreme outer edge non-program area of the disc.

The package sleeve of U.S. patent application Ser. No. 08/261,681 also has printed areas 44 on one side of the front portion 16, back portion 20 and side flap portion 26 and 28 of the blank 10 (See FIG. 1) to provide printed information, such as information about the musical recordings, the artists and other such promotional materials, for the CD or ROM compact disc contained within the package sleeve. After the folding process, the printed areas 44 appear on the exterior surface of the package sleeve (see FIGS. 7 and 8) for visual display to the purchaser.

The side of the package sleeve containing the printed area (i.e., the side of the carton blank 10 shown in FIG. 1) is treated with a coating to provide scratch resistance for the storage media disc. This coating is preferably an aqueous-based acrylic clear coating. One such representative aqueous-based acrylic clear coating is manufactured by Algan, Inc. under the trade designation Algloss Overcoating 3048. This coating typically has the following physical properties:

| | |
|---|---|
| Viscosity | 30–35 seconds, #3 Zahn cup @ 70° F. |
| pH | 8.0–9.0 |
| Non-Volatiles | 40–42% |
| VOC | 1.4 lbs/gallon minus water |
| Weight/Gallon | 8.5–8.7 lbs |
| Freeze/Thaw Stability | One cycle |

By treating the side of FIG. 1 of the carton blank with such a coating, the outer flap portion sides 18*a* and 22*a* which face into the sleeve cavity 42 in the finished package sleeve (see FIGS. 7 and 8) will be so coated. Thus, the interior surfaces and edges of this package sleeve will not scratch or otherwise damage the audio or ROM compact disc when it is contained in the sleeve cavity 42.

As described below, the present invention relates to a label assembly for a package sleeve accommodating a storage media disc, such as the package sleeve of FIGS. 1 through 8 of this application which is described in U.S. patent application Ser. No. 08/261,681. The label assembly of the present invention is illustrated in FIGS. 9 through 11 of this application.

Figure 9:
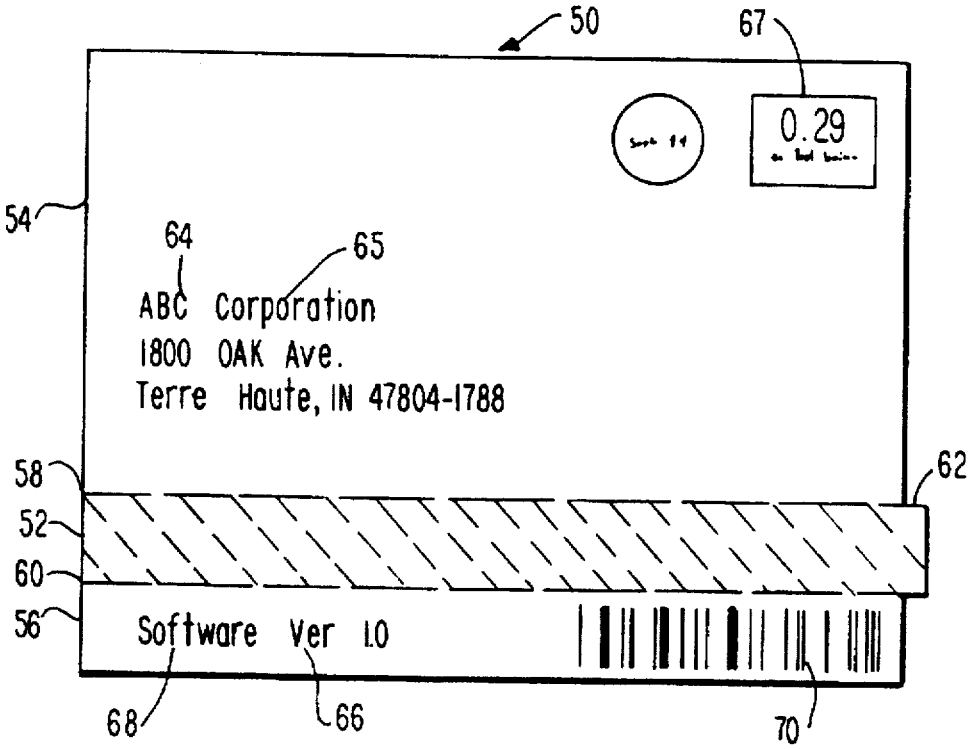
FIG. 9 is a front elevational view of a label assembly in accordance with the teachings of the present invention.
Figure 10:
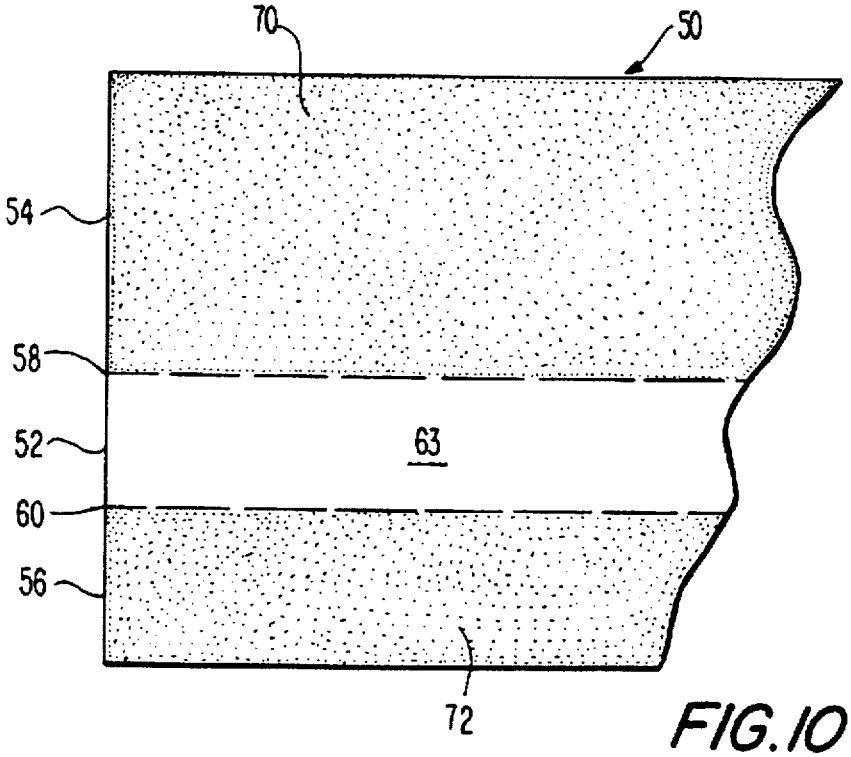
FIG. 10 is a partial rear elevational view of the label assembly of FIG. 9.

Referring now to FIG. 9, the label assembly 50 of the present invention has an overall dimension of approximately 4⅞" in width and 3½" in length and includes three sections: namely; a tear strip 52 and respective first and second faces or parts 54 and 56 provided on opposite sides of the tear strip 52. In order for the label assembly to be applied to a package sleeve, the first and second faces 54 and 56 have respective adhesive backings 70 and 72 (see FIG. 10).

Figure 11:
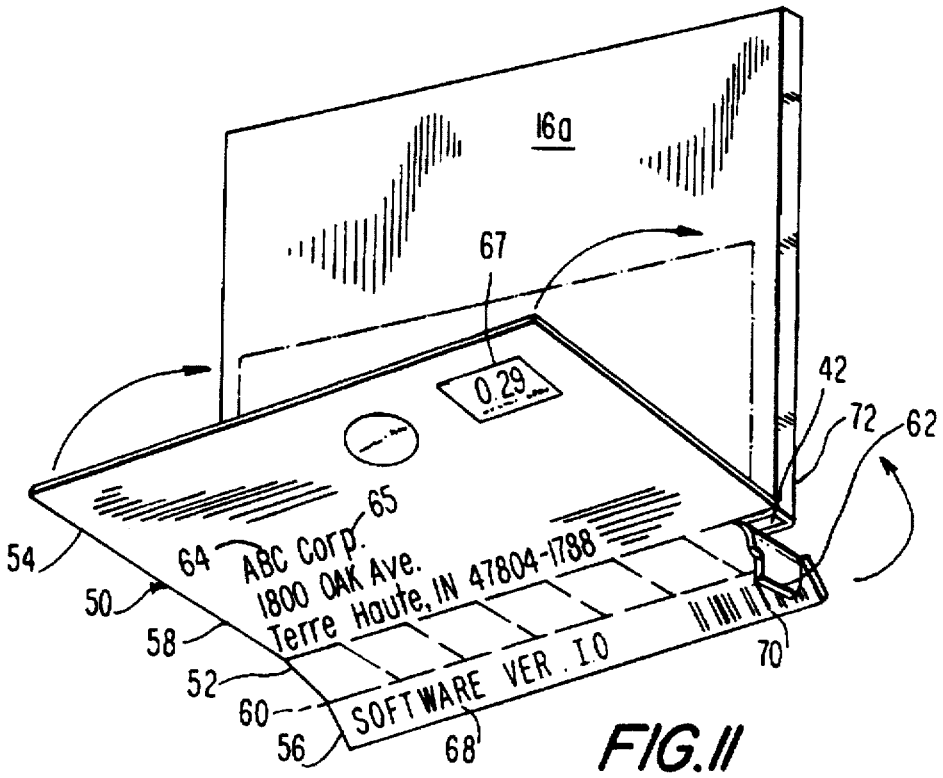
FIG. 11 is a front perspective view of the label assembly of FIGS. 9 and 10 being applied to the finished package sleeve illustrated in FIGS. 7 and 8.

As is shown in FIG. 11, when applied to the package sleeve 10, the tear strip 52 covers the sleeve cavity 42 so that the storage media disc accommodated within the sleeve cavity will be sealed therein until ready for use. The tear strip 52 includes a pair of perforation lines 58 and 60 such that when it is desirable to remove the disc from the sleeve cavity 42, a pull tab 62 provided on the tear strip 52 is lifted and the tear strip is detached along the perforation lines 58 and 60.

In the preferred embodiment, the tear strip 52 is approximately ½" in length and the pull tab 62 extends approximately 3/16" in width from the width of the first and second faces 54 and 56 of the label assembly.

In accordance with one of the general objects of the present invention, the tear strip 52 of the label assembly 50 of the present invention not only seals the open end of the sleeve cavity 42 but is also designed such that it will not scratch or place adhesive on the disc. In accordance therewith, the tear strip 52 includes a deadened adhesive portion 63 covering and facing the open end of the sleeve cavity to assure that no adhesive can contact the disc (see FIG. 10).

The tear strip width is preferably approximately 0.5" so that this label assembly cannot only be used with a package sleeve accommodating a single storage media disc but also be used with package sleeves accommodating double, triple, quad, etc. storage media discs. This label assembly could then be utilized to close multiple single disc package sleeves that are glued together.

In order to distribute a single title within the package sleeve to multiple address locations, the first face 54 of the label assembly 50 includes identifying mailing information 64 printed thereon for shipping (see FIG. 9). This identifying mailing information 64 can include information such as the mailing address 65 of the recipient of the package sleeve, the return address of the sender, postal indicia 67 and a postal bar code. In the preferred embodiment, the first face 54 is approximately 2½" in length.

As illustrated in FIG. 9, the second face 56 includes product identification information 66 regarding the particular disc accommodated within the package sleeve or a product identification bar code regarding the disc. In addition, an address verification bar code 70 can be included on the second face 56 which references the specific mailing information 64 on the first face 54 of label assembly 50 which is to be used by an address verification system.

More specifically, in one preferred embodiment, this product identification information 66 can include text information 68 regarding the disc accommodated within the package sleeve and a product identification bar code (not shown) regarding the disc. As a result thereof, this product identification information assists in tracking the disc in inventory as well as providing additional consumer information regarding the disc. In the preferred embodiment, the second face 56 is approximately ½" in length.

Advantageously, the label material is vinyl for strength (preferably, Walace #401 Kimdura synthetic vinyl), glossy white for appearance and has a permanent adhesive for security. The label material is also print and apply compatible. Thus, the identifying mailing information 64 and product identification information 66 can be printed onto the label assembly immediately before the label assembly is applied to the package sleeve.

Figure 12:
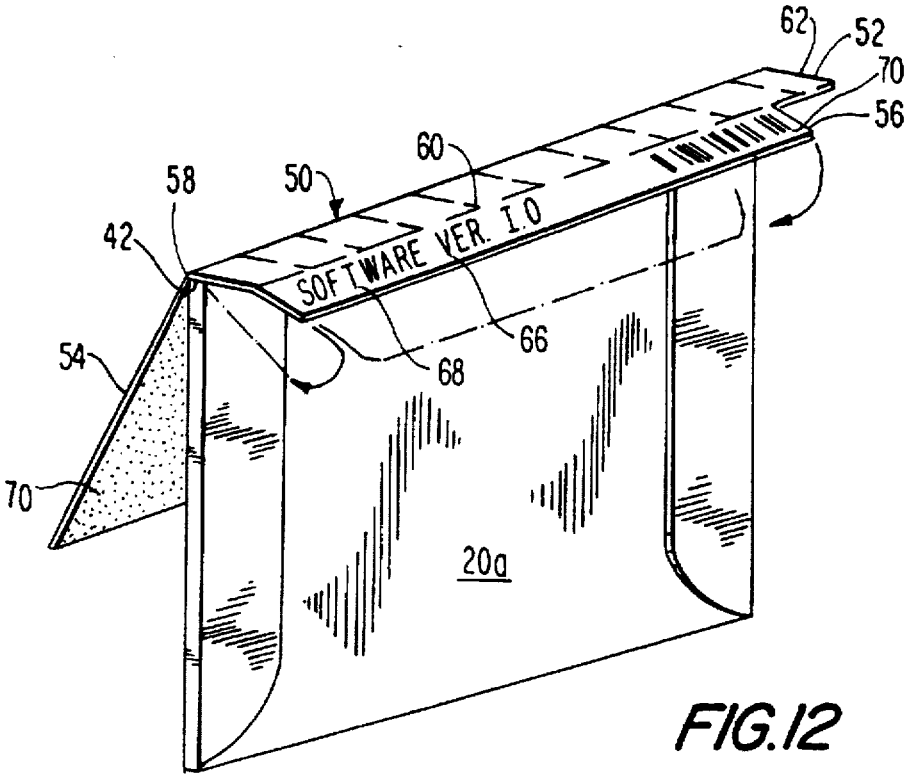
FIG. 12 is a rear perspective view of the label assembly of FIGS. 9 and 10 being applied to the finished package sleeve illustrated in FIGS. 7 and 8.

As is shown in FIGS. 11 and 12, the present invention also relates to a method for sealing a package sleeve, such as the package sleeve described and illustrated in U.S. patent application Ser. No. 08/261,681. In this method, the sleeve cavity 42 of the package sleeve is covered with the removable tear strip 52 to reliably seal the sleeve cavity and retain the storage media disc within the sleeve cavity. When the strip 52 covers the sleeve cavity, the deadened adhesive portion 63 of the tear strip 52 faces the sleeve cavity so that no adhesive can contact the disc accommodated within the sleeve cavity. When it is desired to remove the storage media disc from the sleeve cavity, the pull tab 62 is lifted upwardly such that the tear strip 52 is detached along perforation lines 58 and 60 to thereby open the sleeve cavity.

As is set forth below, the present invention further relates to a method for providing mailing information and product identification information regarding the package sleeve and disc accommodated therein. Initially, the first and second faces 54 and 56 of the label assembly are folded inwardly along the perforation lines 58 and 60. The adhesive backing 70 of the first face 54 is then adhesively attached to the front portion 16*a* (see FIGS. 7 and 11) of the package sleeve. As a result thereof, the mailing identification information 64 of the first face 54 is attached to the front portion 16*a*. Similarly, the adhesive backing 72 of the second face 56 is adhesively attached to the rear portion 20*a* (see FIGS. 8 and 12) of the package sleeve. In this manner, the product identification information 66 of the second face 56 is attached to back portion 20*a*. When adhesively applied, the mailing identification information 64 and the product identification information 66 are exposed and therefore the information contained thereon can be visually read and/or scanned with a bar code reader.

The label assembly 50 of the present invention can be automated using a one step process. Speeds can be approximately 60 parts per minute with each part having a 0.4–0.5 second dwell. Physically, the automation cell can be less than approximately 4 feet in length.

Figure 13:
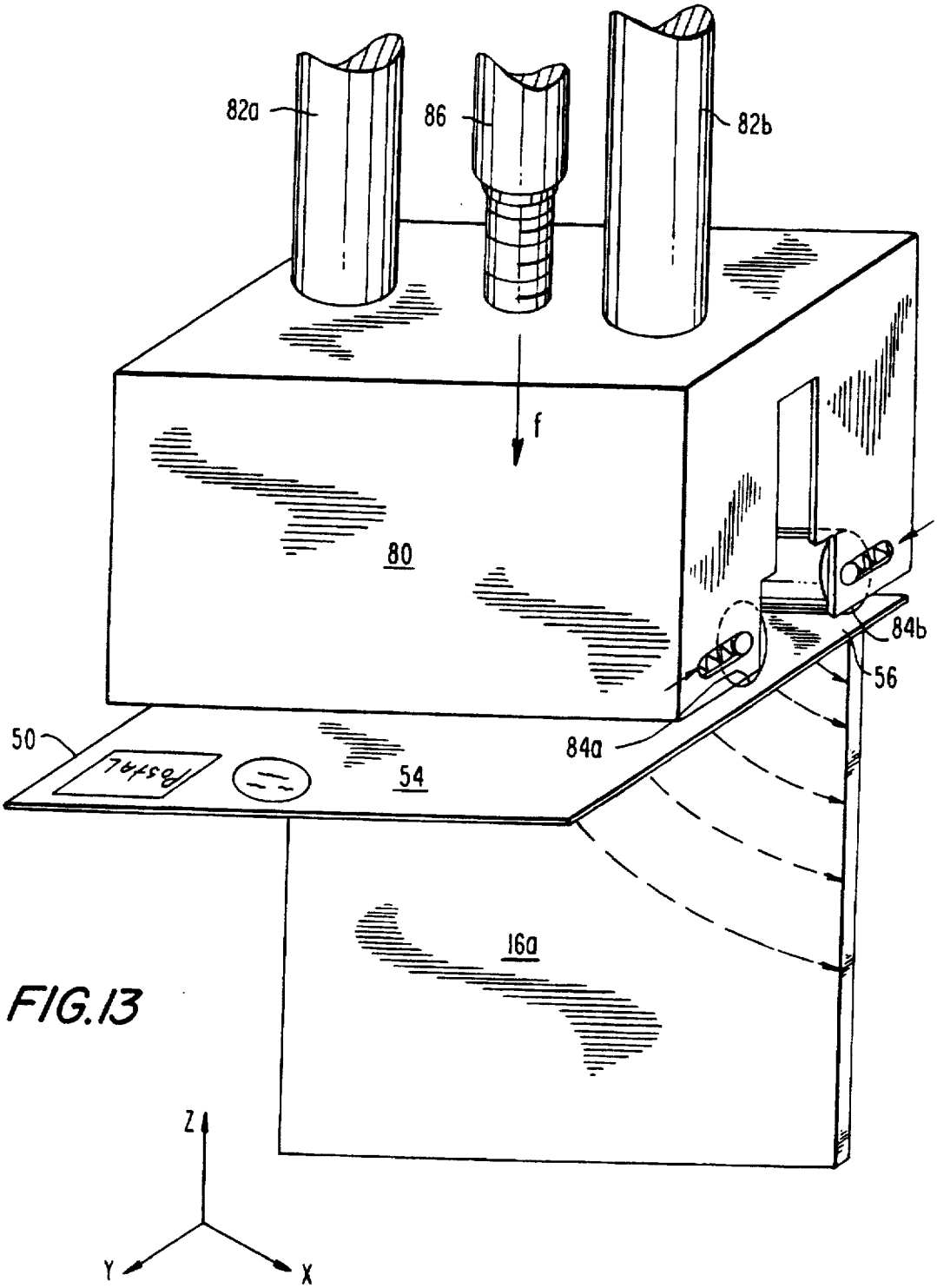
FIG. 13 is a front perspective view of a preferred embodiment for applying the label assembly of FIGS. 9 through 12 to the finished package sleeve illustrated in FIGS. 7 and 8.

This one-step automated process is shown in FIG. 13. The label assembly 50 is fed out of a printer (not shown) onto a tamp block 80 supported by a pair of guide rods 82*a* and 82*b*. The package sleeve is in a staged position between a pair of spring loaded rollers 84*a* and 84*b* of the tamp block 80. Upon actuation of a tamp cylinder 86, the tamp block 80 is moved in generally the direction of arrow f such that the spring loaded rollers 84*a* and 84*b* impart a force respectively to the first face 54 and second face 56 of the label assembly to move the faces 54 and 56 inwardly toward the package sleeve in the direction of arrow g. The faces 54 and 56 are moved by the rollers 82*a* and 82*b* until the first face 54 is attached to the front face 16*a* of the package sleeve and the second face 56 is attached to the rear face 20*a* of the package sleeve by means of the adhesive backings 70 and 72. The first and second faces 54 and 56 of the label assembly are then smoothed over the package sleeve by the rotational force applied by the rollers 82*a* and 82*b*.

Based upon the foregoing, the label assembly of the present invention when applied to a package sleeve forms a secure package by which a single CD-ROM can be mailed. Upon receipt, the pull tab is lifted and the deadened tear strip is removed to open the sleeve. The disc accommodated in the sleeve cavity can then be removed without damage. The label assembly is further designed so that all necessary mailing information is printed on the label just before it is automatically applied. As a result, the label assembly of the present invention is a cost effective means to distribute a single title to multiple address locations. In addition, the combination package sleeve/label assembly is economical to mail due to its reduced size and weight.

While the present invention has been shown and described with reference to certain preferred embodiments, it will be readily apparent to those of ordinary skill in the art that various changes and modifications may be made therein without departing from the spirit and scope of the invention. For instance, an identifying bar code can be printed on the back of each label assembly so that a bar code reader can scan each printed label after application. A data base can then compare "Finished Work" to "Requested Work" with any discrepancies noted. This closed loop address verification can be extended to a serialized CD-ROM with an identifying bar code sticker which can also be scanned with a bar code reader. This additional information can also be written to the "Finished Work" data base. A report can then be generated to show the exact address location of the particular package sleeve.

It is intended that the appended claims be interpreted as including the foregoing as well as various other changes and modifications.

What is claimed is:

1. A package sleeve label assembly comprising a package sleeve including a sleeve cavity for accommodating a storage media disc therein and having a front portion and a back portion opposed to said front portion, a label assembly adhesively applied to said package sleeve so as to form in cooperation with said package sleeve a mailable sleeve assembly, said label assembly comprising a unitary structure formed of a combination of a removable tear strip, mailing identification information means for identifying mailing information regarding the package sleeve and product identification information means for providing product identifying information regarding the storage media disc accommodated within the package sleeve wherein said mailing identification means and said product identification means are provided on opposite sides of said tear strip, said tear strip providing a closure flap for the sleeve cavity so as to retain the disc in the sleeve cavity and upon removal thereof from said label assembly, the disc can be removed from the sleeve cavity, said mailing identification information means provided on said label assembly being adhesively applied to said front portion of said package sleeve and said product identification information means provided on said label assembly being adhesively attached to said back portion of said package sleeve, said tear strip having a non-adhesive portion facing the sleeve cavity so that no adhesive can contact the disc.

2. The package sleeve label assembly of claim 1 wherein said tear strip is a perforated tear strip.

3. The package sleeve label assembly of claim 1 wherein said label assembly is vinyl.

4. A package sleeve label assembly comprising a package sleeve including a sleeve cavity for accommodating a storage media disc therein and having a front portion and a back portion opposed to said front portion, and a label assembly adhesively applied to said package sleeve so as to form in cooperation with said package sleeve a mailable sleeve assembly, said label assembly comprising a unitary structure formed of a combination of a removable tear strip, a first face including mailing identification information means for identifying mailing information regarding the package sleeve and a second face including product identification information means for providing product identifying information regarding the storage media disc accommodated within the package sleeve wherein said first face and said second face are provided on opposite sides of said tear strip, said tear strip providing a closure flap for the sleeve cavity so as to retain disc in the sleeve cavity and upon removal thereof from the label assembly, the disc can be easily removed from and re-inserted into the sleeve cavity and said first face remains applied to said front portion and said second face remains applied to said back portion.

5. The label assembly of claim 4 wherein said mailing identification information means includes mailing identification information selected from the group consisting of a mailing address, a return address, postal indicia and means for encoding postal information.

6. The package sleeve label assembly of claim 4 wherein said mailing identification information means includes means for encoding postal information which is a postal bar code.

7. The package sleeve label assembly of claim 4 wherein said disc identification information means includes disc identification information selected from the group consisting of text information regarding the disc and means for encoding disc information.

8. The package sleeve label assembly of claim 4 wherein said disc identification information means includes means for encoding disc information which is a product identification bar code for the disc.

9. The package sleeve label assembly of claim 4 wherein an address verification bar code is provided on said second face of said label assembly.

10. A package sleeve label assembly comprising:

a package sleeve including a sleeve cavity for accommodating a storage media disc therein and having a front portion and a back portion opposed to said front portion;

a label assembly adhesively applied to said package sleeve so as to form in cooperation with said package sleeve a mailable sleeve assembly, said label assembly comprising a unitary structure formed of a combination of a removable tear strip, a first face including mailing identification information means for identifying mailing information regarding the package sleeve and a second face including product identification information means for providing product identifying information regarding the storage media disc accommodated within the package sleeve wherein said first face and said second face are provided on opposite sides of said tear strip, said tear strip providing a closure flap for the sleeve cavity so as to retain the disc in the sleeve cavity and upon removal thereof from said label assembly, the disc can be easily removed from and re-inserted into the sleeve cavity, said tear strip having a non-adhesive portion facing the sleeve cavity so that no adhesive can contact the disc; and wherein when said tear strip is detached, said mailing identification means of said first face remains applied to said front portion of said package sleeve and said product identification means of said second face remains applied to said back portion of said package sleeve.

11. The package sleeve label assembly of claim 10 wherein said tear strip is a perforated tear strip.

12. The package sleeve label assembly of claim 10 wherein said label assembly is vinyl.

13. The package sleeve label assembly of claim 10 wherein said mailing identification means includes mailing identification information selected from the group consisting of a mailing address, a return address, postal indicia and means for encoding postal information.

14. The package sleeve label assembly of claim 10 wherein said mailing identification means includes means for encoding postal information which is a postal bar code.

15. The package sleeve label assembly of claim 10 wherein said disc identification means includes disc identification information selected from the group consisting of text information regarding the disc and means for encoding disc information.

16. The package sleeve label assembly of claim 10 wherein said disc identification means includes means for encoding disc information which is a product identification bar code for the disc.

17. The package sleeve label assembly of claim 10 wherein an address verification bar code is provided on said second face of said label assembly.

18. A combination storage media disc container/seal identification assembly comprising:

a package sleeve for accommodating a storage media disc therein comprising a front panel and a back panel connected thereto, and two side flap portions connected to said front panel, said front panel comprises a first folded-over double panel having two folded layers of relatively the same size and said back panel comprises a second folded-over double panel and said side flap portions are adhesively attached to said back panel to form a sleeve cavity between said first and second folded-over double panels with an opening formed in said sleeve cavity into which the storage media disc is inserted and removed, and wherein said side flap portions are adhesively attached to said back panel along an exterior surface of said back panel which does not form part of said sleeve cavity and does not form a portion of either of said first or second folded-over double panels, and wherein said side flap portions when adhesively attached to said back panel permit said storage media disc to be inserted into and removed from said opening of said sleeve cavity; and a label assembly adhesively applied to said package sleeve so as to form in cooperation with said package sleeve a mailable sleeve assembly, said label assembly comprising a unitary structure formed of a combination of a removable tear strip, a first face including mailing identification information means for identifying mailing information regarding the package sleeve and a second face including product identification information means for providing product identifying information regarding the storage media disc accommodated within the package sleeve, said tear strip providing a closure flap for said sleeve cavity so as to retain the disc in the sleeve cavity and upon removal thereof from said label assembly, the disc can be easily removed from and re-inserted into said sleeve cavity, said tear strip having a non-adhesive portion facing the sleeve cavity so that no adhesive can contact the disc, wherein said said first face and said second face are positioned on opposite sides of said tear strip.

19. The combination storage media disc container/seal identification assembly of claim 18 wherein at least the portions of said first and second folded-over double panels facing said sleeve cavity are treated with a coating to provide scratch resistance for the storage media disc.

20. The combination storage media disc container/seal identification assembly of claim 18 wherein said tear strip is a perforated tear strip.

21. The combination storage media disc container/seal identification assembly of claim 18 wherein said label assembly is vinyl.

22. The combination storage media disc container/seal identification assembly of claim 18 wherein said first face is applied to said front panel of said package sleeve and said second face is applied to said back panel of said package sleeve.

23. The combination storage media disc container/seal identification assembly of claim 18 wherein said mailing identification means includes mailing identification information selected from the group consisting of a mailing address, a return address, postal indicia, and a postal bar code.

24. The combination storage media disc container/seal identification assembly of claim 18 wherein said disc identification means includes disc identification information selected from the group consisting of text information regarding the disc and a product identification bar code for the disc.

25. The combination storage media disc container/seal identification assembly of claim 18 wherein an address verification bar code is provided on said second face of said label assembly.

26. A combination storage media disc container/seal identification assembly comprising:

(1) a package sleeve for accommodating the storage media disc including:

(a) a front portion;

(b) first and second side flap portions connected to said front portion along respective first and second bend lines;

(c) a back portion connected to said front portion along a third bend line;

(d) top and bottom outer flap portions connected respectively to said front portion and to said back portion along respective fourth and fifth bend lines; and (e) wherein said top outer flap portion is folded along said fourth bend line and adhesively attached to said front portion to provide a first folded-over double panel having two folded layers of relatively the same size, said bottom outer flap portion is folded along said fifth bend line and adhesively attached to said back portion to provide a second folded-over double panel having two folded layers of relatively the same size, said back portion and said bottom outer flap portion adhered thereto are folded along said third bend line, and said first and second side flap portions are respectively folded along said first and second bend lines and attached to said back portion by adhesive means to thereby form a sleeve cavity between said top and bottom outer flap portions with an opening formed in said sleeve cavity into which the storage media disc is inserted and removed, and wherein said side flap portions are adhesively attached to said back portion along an exterior surface of said back portion which does not form part of said sleeve cavity and does not form a portion of either of said first or second folded-over double panels, and wherein said side flap portions when adhesively attached to said back panel permit said storage media disc to be inserted into and removed from said opening of said sleeve cavity; and (2) a label assembly applied to said package sleeve so as to form in cooperation with said package sleeve a mailable sleeve assembly, said label assembly comprising a unitary structure formed of a combination of:

(a) a removable tear strip providing a closure flap for said sleeve cavity so as to retain the disc in the sleeve cavity and upon removal thereof from said label assembly, the disc can be easily removed from and re inserted into said sleeve cavity, said tear strip having a non-adhesive portion facing the sleeve cavity so that no adhesive can contact the disc; and (b) a first face and a second face positioned on opposite sides of said tear strip with said first face including mailing identification information means for identifying mailing information regarding the package sleeve and said second face including disc identification information means for providing product identifying information regarding the storage media disc accommodated within said package sleeve.

27. The combination storage media disc container/seal identification assembly of claim 26 wherein an address verification bar code is provided on said second face of said label assembly.

28. A method for sealing a package sleeve having a front portion and a back portion and which accommodates information media within a sleeve cavity provided between the front and rear faces and for removing the information media from the sleeve cavity, said method comprising the steps of sealing the sleeve cavity with an adhesive label assembly so as to form in cooperation with said package sleeve a mailable sleeve assembly with said label assembly comprising a unitary structure formed of a combination of a removable tear strip, mailing identification information means for identifying mailing information regarding the package sleeve and product identification information means for product identifying information regarding the information media accommodated within the package sleeve, wherein said mailing identification means and said product identification means are provided on opposite sides of said tear strip, said tear strip providing a closure flap for the sleeve cavity so as to retain the information media in the sleeve cavity, and detaching said tear strip from said label assembly along perforation lines provided in said label assembly to easily remove the information media from the sleeve cavity and reinsert the information media into the sleeve cavity and adhesively applying said mailing identification information means provided on said label assembly to said front portion of said package sleeve and adhesively applying said product identification information means provided on said label assembly to said back portion of said package sleeve.

29. A method for providing information regarding information media accommodated within a sleeve cavity of a package sleeve having a front portion and a back portion and for providing mailing information and product identification information concerning the package sleeve and information media accommodated therein and an address verification bar code, said method comprising the steps of:

sealing the sleeve cavity with a label assembly so as to form in cooperation with said package sleeve a mailable sleeve assembly with said label assembly comprising a unitary structure formed on a combination of a removable tear strip, mailing identification information means for identifying mailing information regarding the package sleeve and product identification information means for providing product identifying information regarding the information media accommodated within the package sleeve;

positioning said tear strip of said label assembly over said sleeve cavity so as to provide closure flap for the sleeve cavity so as to retain the information media in the sleeve cavity;

applying a first portion of said label assembly including said mailing identification information means to the front portion of the package sleeve; and applying a second portion of said label assembly including said product identification information means including media identification information and the address verification bar code to the back portion of the package sleeve, wherein the steps of applying the first and second portions of said label assembly respectively to the front and back portions of the package sleeve occur in a single operation.

30. The method of claim 29 wherein said mailing identification information is mailing identification information selected from the group consisting of a mailing address, a return address, postal indicia and a postal bar code.

31. The method of claim 29 wherein said media identification information is media identification information selected from the group consisting of text information regarding the information media and a product identification bar code regarding the information media.

32. A method for sealing a package sleeve having a front portion and a back portion and which accommodates information media within a sleeve cavity provided between the front and back portions and for providing mailing information and product identification information concerning the package sleeve and an address verification bar code and for removing the information media from the sleeve cavity, the method comprising the steps of:

sealing the sleeve cavity with a label assembly so as to form in cooperation with said package sleeve a mailable sleeve assembly and to provide a closure flap for the sleeve cavity so as to retain the information media in the sleeve cavity with said label assembly comprising a unitary structure formed of a combination of a removable tear strip, mailing identification information means for identifying mailing information regarding the package sleeve and product identification information means for providing product identifying information regarding the information media accommodated within the package sleeve;

adhesively applying a first face of said label assembly including said mailing identification information means to the front portion of the package sleeve; and adhesively applying a second face of said label assembly including said product identification information means including media identification information and the address verification bar code to the back portion of the package sleeve, wherein the steps of applying the first and second faces of the label assembly respectively to the front and back portions of the package sleeve occur in a single operation.

33. The method of claim 32 and further comprising the step of detaching said tear strip along perforation lines provided in said label assembly to remove the information media from the sleeve cavity.

34. The method of claim 32 and further comprising the step of positioning a non-adhesive portion of said tear strip to face said sleeve cavity so that no adhesive can contact the information media.

35. A method for making a package sleeve for accommodating information media therein from a carton blank comprising a front portion, first and second side flap portions connected to said front portion along respective first and second bend lines, a back portion connected to said front portion along a third bend line, and top and bottom outer flap portions connected respectively to said front portion and to said back portion along respective fourth and fifth bend lines and for sealing the package sleeve, said method comprising the steps of:

(a) folding said top outer flap portion along said fourth bend line;

(b) adhesively attaching said top outer flap portion to said front portion;

(c) folding said bottom outer flap portion along said fifth bend line;

(d) adhesively attaching said bottom outer flap portion to said back portion;

(e) folding said back portion and said bottom outer flap portion adhered thereto along said third bend line;

(f) folding said first and second side flap portions along respectively said first and second bend lines, respectively;

(g) adhesively attaching said first and second side flap portions to said back portion to thereby form a sleeve cavity between said top and bottom outer flap portions with an opening in said sleeve cavity into which the information media is removed and re-inserted, and said side flap portions when attached to said back portion permit said information media to be inserted into and removed from the opening of said sleeve cavity;

(h) sealing the sleeve cavity with a label assembly comprising a unitary structure formed of a combination of a removable tear strip, mailing identification information means for identifying mailing information regarding the leakage sleeve and product identification information means for providing product identifying information regarding the information media accommodated within the package sleeve with said tear strip covering the sleeve cavity so as to form in cooperation with said package sleeve a mailable sleeve assembly and to provide a closure flap for the opening of said sleeve cavity so as to retain the information media in the sleeve cavity;

(i) adhesively applying a first face of said label assembly including said mailing identification information means to the front panel of the package sleeve; and (j) adhesively applying a second face of said label assembly including said product identification information means including media identification information and an address verification bar code to the back panel of the package sleeve, wherein the steps of applying the first and second faces of said label assembly respectively to the front and back portions of the package sleeve occur in a single operation.

36. The method of claim 35 and further comprising the step of positioning a non-adhesive portion of said tear strip to face said sleeve cavity so that no adhesive can contact the information media.

* * * * *